US009682578B2

(12) United States Patent
Kozuma

(10) Patent No.: US 9,682,578 B2
(45) Date of Patent: Jun. 20, 2017

(54) RECORDING APPARATUS, METHOD FOR TRANSPORTING RECORDING MEDIUM, AND METHOD FOR NOTIFYING INFORMATION OF REMAINING AMOUNT OF RECORDING MEDIUM

(71) Applicant: SEIKO EPSON CORPORATION, Tokyo (JP)

(72) Inventor: Itaru Kozuma, Matsumoto Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/092,752

(22) Filed: Apr. 7, 2016

(65) Prior Publication Data

US 2016/0214414 A1 Jul. 28, 2016

Related U.S. Application Data

(63) Continuation of application No. 14/638,352, filed on Mar. 4, 2015, now Pat. No. 9,333,774.

(30) Foreign Application Priority Data

Mar. 12, 2014 (JP) ..... 2014-049052

(51) Int. Cl.
*B41J 13/00* (2006.01)
*B41J 15/00* (2006.01)
(Continued)

(52) U.S. Cl.
CPC ..... *B41J 13/0009* (2013.01); *B41J 15/005* (2013.01); *B65H 23/185* (2013.01);
(Continued)

(58) Field of Classification Search
CPC ... B41J 15/005; B41J 13/0009; B65H 23/192; B65H 26/06; B65H 23/185;
(Continued)

(56) References Cited

U.S. PATENT DOCUMENTS 4,893,763 A 1/1990 Wales et al.
5,501,412 A 3/1996 McAleavey
(Continued)

FOREIGN PATENT DOCUMENTS

EP 2423136 A2 2/2012
JP 61-064478 A 4/1986
(Continued)

OTHER PUBLICATIONS

The Extended European Search Report for the corresponding European Application No. 15158734.2 dated Aug. 25, 2015.

*Primary Examiner* — Justin Seo
(74) *Attorney, Agent, or Firm* — Global IP Counselors, LLP

(57) ABSTRACT

A method is for notifying information of a remaining amount of a recording medium in a recording apparatus including a delivery section that rotates and delivers a roll-shaped recording medium, a transport belt that transports the recording medium delivered from the delivery section, and a slack sensor that detects a slackened state in the recording medium delivered from the delivery section to the transport belt. The method includes notifying the information of the remaining amount of the recording medium if the slack sensor detects a lack of slack of the recording medium in a period of a first time or more.

1 Claim, 7 Drawing Sheets

(51) Int. Cl.
*B65H 23/185* (2006.01)
*B65H 23/192* (2006.01)
*B65H 26/06* (2006.01)

(52) U.S. Cl.
CPC ..... *B65H 23/192* (2013.01); *B65H 26/06* (2013.01); *B65H 2301/4493* (2013.01); *B65H 2404/20* (2013.01); *B65H 2511/112* (2013.01); *B65H 2513/106* (2013.01); *B65H 2553/414* (2013.01); *B65H 2801/12* (2013.01)

(58) Field of Classification Search
CPC ..... B65H 2301/4493; B65H 2511/112; B65H 2513/106; B65H 2553/414; B65H 2801/12; B65H 2404/20
See application file for complete search history.

(56) References Cited

U.S. PATENT DOCUMENTS

| | | | | |
|---|---|---|---|---|
| 5,505,401 | A | 4/1996 | Lamothe | |
| 5,617,134 | A | 4/1997 | Lamothe | |
| 5,794,869 | A | 8/1998 | Takano et al. | |
| 2002/0154202 | A1* | 10/2002 | Yamamoto ..... | B41J 3/4078 347/104 |
| 2006/0055760 | A1 | 3/2006 | Cummins et al. | |
| 2006/0115313 | A1 | 6/2006 | Shaw, III | |
| 2012/0087707 | A1 | 4/2012 | Igarashi | |

FOREIGN PATENT DOCUMENTS

| | | | |
|---|---|---|---|
| JP | 11-245916 | A | 9/1999 |
| JP | 2002-249976 | A | 9/2002 |
| JP | 2004-345728 | A | 12/2004 |

* cited by examiner

RECORDING APPARATUS, METHOD FOR TRANSPORTING RECORDING MEDIUM, AND METHOD FOR NOTIFYING INFORMATION OF REMAINING AMOUNT OF RECORDING MEDIUM

CROSS-REFERENCE TO RELATED APPLICATIONS

This is a continuation application of U.S. patent application Ser. No. 14/638,352 filed on Mar. 4, 2015. This application claims priority to Japanese Patent Application No. 2014-49052 filed on Mar. 12, 2014. The entire disclosures of U.S. patent application Ser. No. 14/638,352 and Japanese Patent Application No. 2014-49052 are expressly incorporated by reference herein.

BACKGROUND

1. Technical Field

The present invention relates to a recording apparatus, a method for transporting a recording medium, and a method for notifying information of a remaining amount of the recording medium.

2. Related Art

In the related art, recording apparatuses capable of transporting a roll-shaped recording medium are disclosed. Among them, a recording apparatus capable of transporting the roll-shaped recording medium in a state of being slackened is used.

For example, the recording apparatus that suppresses the lack of slack by rotating a rotation driving unit of a delivery section of the roll-shaped recording medium if a lack of slack is detected by a sensor is disclosed in JP-A-2002-249976.

However, since a roll diameter is greatly changed between a start of use and an end of use depending on a type of a recording medium which is used, it is difficult to transport the recording medium while suppressing the lack of slack of the recording medium.

SUMMARY

An advantage of some aspects of the invention is to transport a recording medium while suppressing a lack of slack of the recording medium in a recording apparatus capable of transporting a roll-shaped recording medium in a state of being slackened.

According to one aspect of the invention, there is provided a method for notifying information of a remaining amount of a recording medium in a recording apparatus including a delivery section that rotates and delivers a roll-shaped recording medium, a transport belt that transports the recording medium delivered from the delivery section, and a slack sensor that detects a slackened state in the recording medium delivered from the delivery section to the transport belt, the method including: notifying the information of the remaining amount of the recording medium if the slack sensor detects a lack of slack of the recording medium in a period of a first time or more.

In this case, it is possible to transport the recording medium while suppressing the lack of slack of the recording medium in the recording apparatus capable of transporting the roll-shaped recording medium in the slackened state.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described in detail with reference to drawings.

Embodiment of Recording Apparatus (FIGS. 1 to 5)

Figure 1:
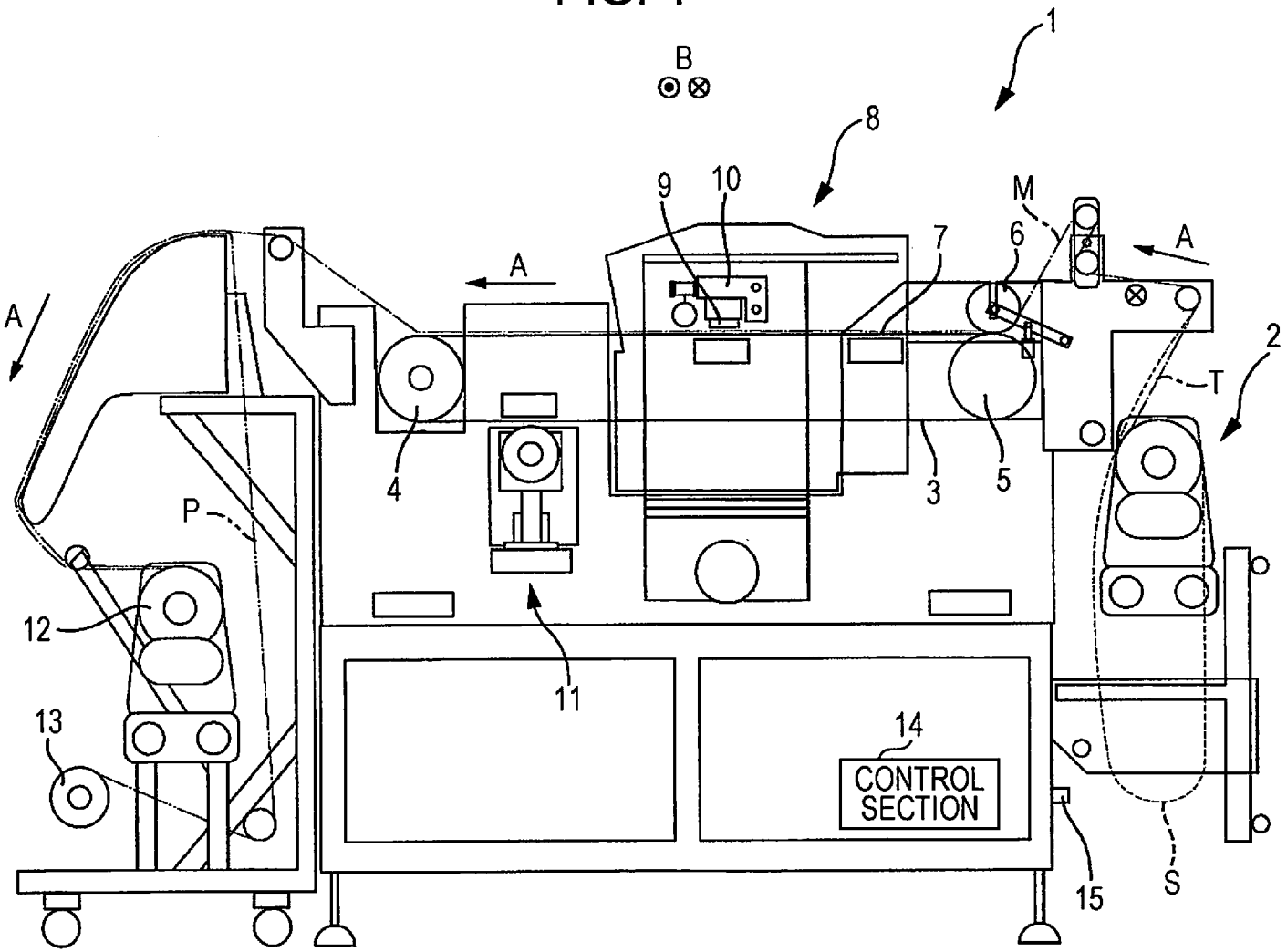
FIG. 1 is a schematic side view illustrating a recording apparatus according to an embodiment of the invention.

FIG. 1 is a schematic side view illustrating a recording apparatus 1 according to an embodiment of the invention.

The recording apparatus 1 according to the embodiment includes a delivery section 2 that rotates and delivers a roll-shaped recording medium M. The delivery section 2 of the embodiment can deliver the recording medium M to a transport belt 3 in delivery paths of two types of a tension feeding path T in which the recording medium M is delivered to the transport belt 3 in a tensioned state and a slack feeding path S in which the recording medium M is delivered to the transport belt 3 in a slackened state.

The recording apparatus 1 of the embodiment is provided with a slack sensor 15 that detects whether or not the recording medium M is slackened to a predetermined amount of slack or more when the recording medium M is delivered to the transport belt 3 in the slackened state. The slack sensor 15 performs application of light to an object. The slack sensor 15 is an optical sensor capable of detecting whether or not reflected light from the object is present. Thus, if the reflected light is detected by the slack sensor 15, it is determined that the recording medium M is in a state of being positioned in a detection position of the slack sensor 15 and in the slackened state of a predetermined amount of slack or more. If the reflected light is not detected by the slack sensor 15, the recording medium M is in a state of not being positioned in the detection position of the slack sensor 15 and in a state of detecting a lack of slack. Moreover, the slack sensor 15 is an optical sensor capable of detecting whether or not the recording medium M is present in a predetermined position, but a sensor such as a contact type sensor having a configuration other than the optical sensor of the embodiment may be used.

The transport belt 3 of the embodiment is an endless belt in which adhesive is applied to a support surface 7 supporting the recording medium M and which bridges between a driving roller 4 and a driven roller 5 while tension is applied.

Furthermore, a pressing roller 6 is provided at a position facing the driven roller 5 and the recording medium M delivered from the delivery section 2 is mounted on the transport belt 3 while being pressed to the transport belt 3 by the pressing roller 6.

Thus, the recording medium M mounted on the transport belt 3 is transported in a transport direction A by rotational movement of the transport belt 3 by a driving force of the driving roller 4.

A recording section 8 is provided at a position facing the support surface 7 of the transport belt 3 in a transport path of the recording medium M according to the transport belt 3. The recording section 8 includes a recording head 9 that ejects ink onto the recording medium M and a carriage 10 on which the recording head 9 is mounted and reciprocates in a direction B orthogonal to the transport direction A.

As described above, the recording section 8 of the embodiment performs recording by reciprocating the recording head 9 in the direction B. In a recording operation, when the recording head 9 is moved in the direction B, the transport belt 3 is stopped and when the movement of the recording head 9 in one direction in the direction B is completed, the transport belt 3 is stopped after moving by predetermined amount. Thus, the recording head 9 moves in a reverse direction to the one direction in the direction B when the transport belt 3 is stopped after the transport belt 3 moves by predetermined amount. That is, the transport belt 3 of the embodiment is intermittently moved corresponding to reciprocating movement of the recording head 9.

Moreover, the recording apparatus 1 of the embodiment includes the recording head 9 that performs recording while reciprocating, but may be a recording apparatus including a so-called line head in which a plurality of nozzles ejecting the ink are provided in the direction B intersecting the transport direction A.

Here, "line head" is a recording head which is used for the recording apparatus in which a region of the nozzles formed in the direction B intersecting the transport direction A of the recording medium M is provided so as to cover an entirety of the recording medium M in the direction B, one of the recording head and the recording medium M is fixed and the other is moved, and thereby an image is formed. Moreover, the region of the nozzles in the direction B of the line head may not cover the entirety of all recording media M corresponding to the recording apparatus in the direction B.

Moreover, the recording apparatus 1 of the embodiment is configured such that the recording can be performed to an end portion of the recording medium M in a width direction (direction B) and, at this time, the ink ejected from the recording head 9 may be attached to the transport belt 3. Thus, the recording apparatus 1 of the embodiment is provided with a cleaning section 11 capable of cleaning the transport belt 3 to which the ink attached.

The recording medium M on which the recording is performed by the recording head 9 is wound by a winding section 12 and the recording apparatus 1 of the embodiment is configured such that the recording medium M can be wound with a roll sheet P interposed therebetween to suppress ink offset in the recording medium M on which the recording is completed and which is wound in the winding section 12. Winding of the recording medium M with the roll sheet P interposed therebetween can be performed by setting the roll sheet P in a roll sheet delivery section 13 and positioning the roll sheet P along a surface opposite to a recording surface of the recording medium M from the transport belt 3 to the winding section 12, and winding the recording medium M and the roll sheet P together in the winding section 12.

Furthermore, the recording apparatus 1 of the embodiment has a CPU for controlling an entirety of the recording apparatus 1, a ROM for storing various control programs which are executed by the CPU, a RAM capable of temporarily storing data, and the like. The recording apparatus 1 is provided with a control section 14 performing driving control of each configuration member of a driving system of the recording apparatus 1.

Next, an electric configuration in the recording apparatus 1 of the embodiment will be described.

Figure 2:
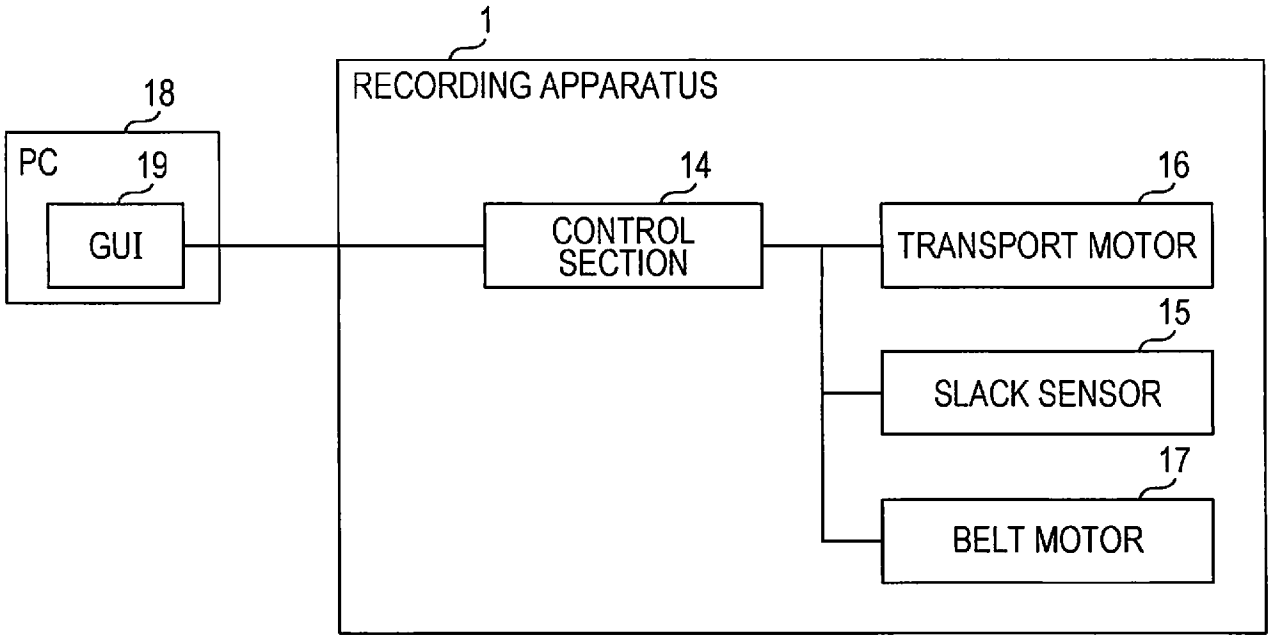
FIG. 2 is a block diagram illustrating the recording apparatus according to the embodiment of the invention.

FIG. 2 is a block diagram of the recording apparatus 1 of the embodiment.

The recording apparatus 1 of the embodiment has the control section 14. The control section 14 is connected to each configuration member of the driving system of the recording apparatus 1 such as a delivery motor 16 that is a driving source of the delivery section 2, the slack sensor 15, and a belt motor 17 that is a driving source of the driving roller 4 that drives rotation of the transport belt 3.

Furthermore, the control section 14 can connect to a PC 18 that is an external device through an interface (not illustrated) and can receive an instruction from a user through a graphic user interface (GUI) 19 of the PC 18.

According to such a configuration, the control section 14 of the embodiment can control driving of each configuration member of the driving system of the recording apparatus 1 such as the delivery motor 16, the slack sensor 15, and the belt motor 17 based on the instruction of the user input from the GUI 19.

Next, control of the delivery motor 16, the slack sensor 15, and the belt motor 17 by the control section 14 when delivering the recording medium M will be described.

Figure 3:
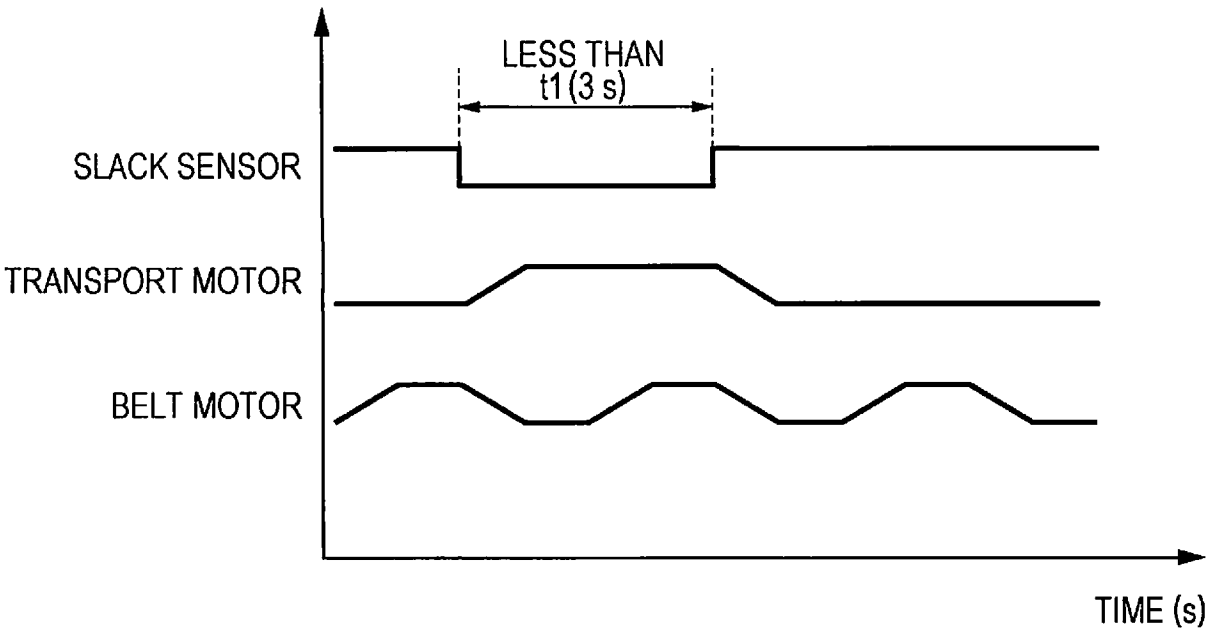
FIG. 3 is a time chart when transporting a recording medium in the recording apparatus according to the embodiment of the invention.
Figure 4:
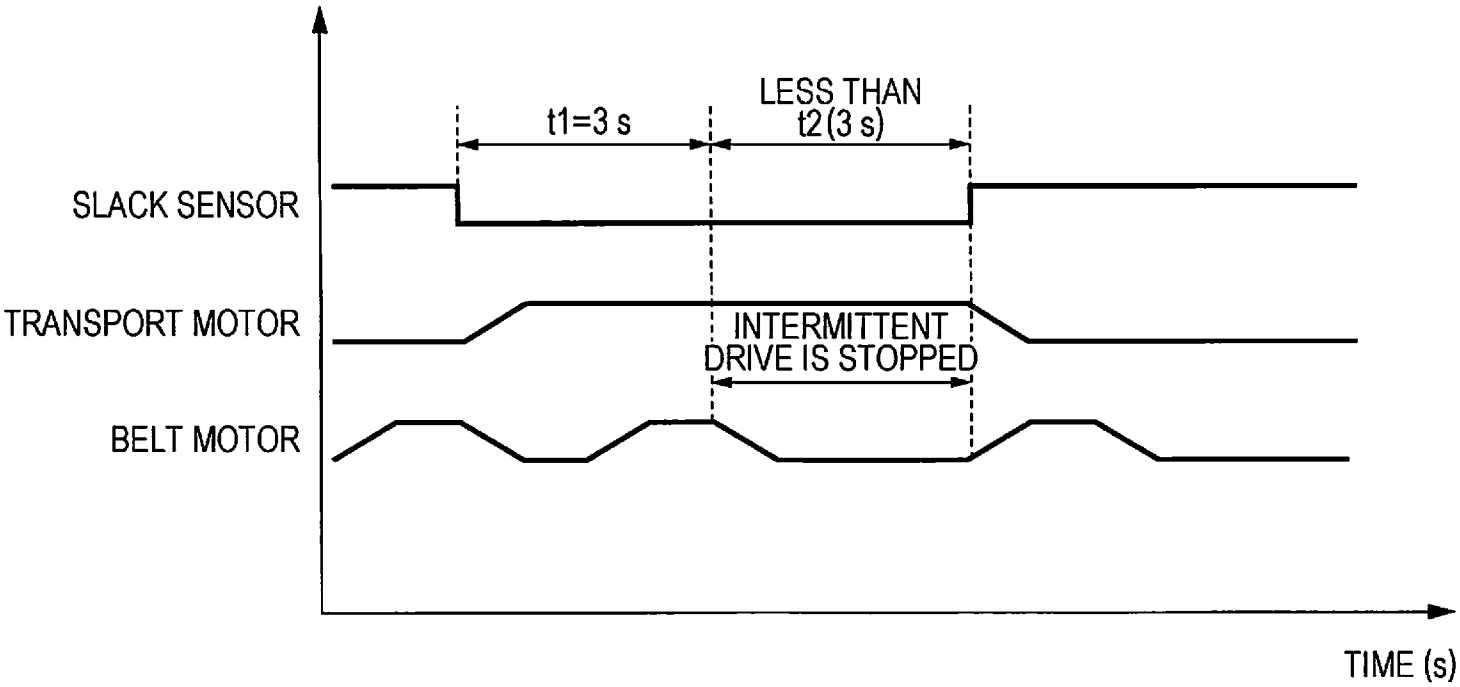
FIG. 4 is a time chart when transporting the recording medium in the recording apparatus according to the embodiment of the invention.
Figure 5:
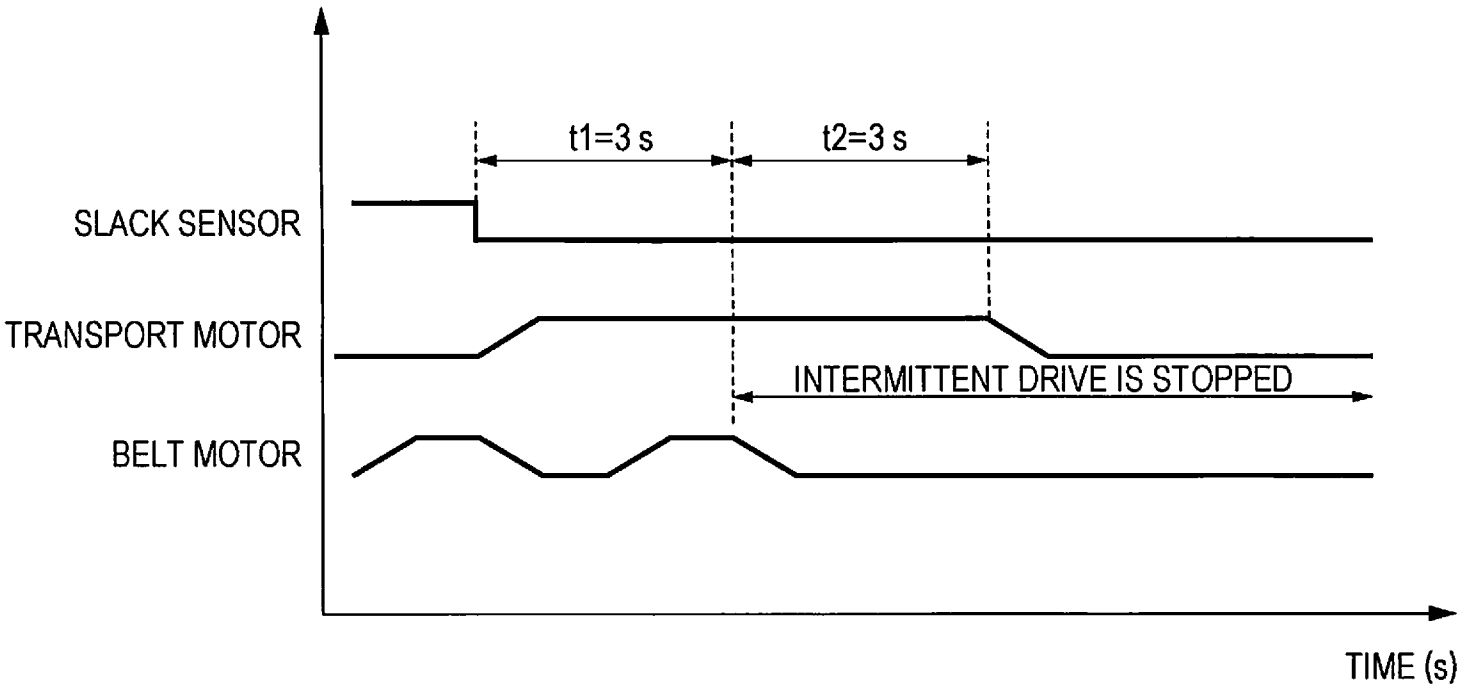
FIG. 5 is a time chart when transporting a recording medium in the recording apparatus according to the embodiment of the invention.

FIGS. 3 to 5 are time charts when transporting the recording medium M in the recording apparatus 1 of the embodiment and illustrate turning on (state of being shifted upward in the drawings) and turning off (state of being shifted downward in the drawings) of the delivery motor 16, the slack sensor 15, and the belt motor 17.

In the recording apparatus 1 of the embodiment, the transport of the recording medium M by the transport belt 3 is intermittently performed in which the movement and stopping are repeated at predetermined intervals as described above. The intermittent transport is performed by intermittently driving the belt motor 17.

Furthermore, the delivery motor 16 has a basic driving operation in which the delivery motor 16 is turned on if the slack sensor 15 detects the lack of slack of the recording medium M and the delivery motor 16 is turned off if the slack sensor 15 detects that the recording medium M is slackened to a predetermined amount of slack or more, that is, the lack of slack is eliminated.

Moreover, the delivery motor 16 of the embodiment is configured of a low-cost motor capable of being driven at a constant rotation speed. Then, if the remaining amount of the recording medium M is large and a roll diameter of the recording medium M is great, a delivery speed of the recording medium M by driving the delivery motor 16 from the delivery section 2 is sufficiently higher than a transport speed of the recording medium M by intermittently driving the belt motor 17, that is, an average transport speed through a moving period and a stop period by the intermittently driving.

FIG. 3 is a time chart of a case where the slack sensor 15 detects the lack of slack of recording medium M in a period less than a first time that is a first threshold, that is, when the slack sensor 15 detects elimination of the lack of slack of the recording medium M before a first time t1 has elapsed. Initially, this state is described.

Moreover, in the embodiment, the first time t1 is set to be three seconds, but may be set to be arbitrarily other than three seconds.

Here, as illustrated in a state view of turning on and turning off of the belt motor 17, when transporting the recording medium M, the recording medium M is intermittently transported whereby the moving and the stopping are repeated at predetermined intervals.

Even if the slack sensor 15 detects the lack of slack of the recording medium M in a period less than the first time t1, the belt motor 17 repeats the driving and the stopping at predetermined intervals. That is, the intermittent transport at a normal speed is continued whereby the moving and the stopping of the recording medium M are repeated at predetermined intervals.

Meanwhile, the delivery motor 16 is turned on according to the detection of the lack of slack of the recording medium M by the slack sensor 15 after the detection, if the slack sensor 15 detects the elimination of the lack of slack of the recording medium M before the first time t1 has elapsed, the delivery motor 16 is turned off and then the speed is gradually decreased and the delivery motor 16 is stopped.

FIG. 4 is a time chart of a case where the slack sensor 15 detects the lack of slack of the recording medium M in the period of the first time t1 or more and a period less than a total time of the first time t1 and a second time t2, that is, when the slack sensor 15 detects the elimination of the lack of slack of the recording medium M in a period indicating a period less than t2 (3 s) in FIG. 4. Next, this state is described.

Moreover, in the embodiment, the second time t2 is set to be three seconds, but may be set to be arbitrarily other than three seconds.

The transport of the recording medium M is intermittently performed at the normal speed in which the moving and the stopping of the recording medium M are repeated at predetermined intervals before the lack of slack of the recording medium M is detected by the slack sensor 15, but if the slack sensor 15 continuously detects the state of the lack of slack of the recording medium M even after the first time t1 has elapsed, new drive of the belt motor 17 is stopped (intermittent transport is stopped).

Then, thereafter, before the second time t2 has elapsed, if the slack sensor 15 detects that the recording medium M has a predetermined amount of slack or more, that is, the lack of slack is also eliminated, the intermittent transport of the recording medium M is resumed. That is, the intermittent transport is stopped until the slack sensor 15 detects that the recording medium M has the predetermined amount of slack or more.

That is, in a state where the slack sensor 15 detects the elimination of the lack of slack of the recording medium M after the first time t1 has elapsed, it can be said that the transport speed (average transport speed) of the recording medium M depending on the transport belt 3 is lower than the normal speed of the intermittent transport.

Moreover, FIG. 4 illustrates a state where the timing when the first time t1 has elapsed matches the timing when the driving of the belt motor 17 is stopped, but the state where the intermittent transport is stopped whereby new driving of the belt motor 17 is stopped described here means that the start of the new intermittent transport is not performed thereafter, and does not mean that the driving of the belt motor is immediately stopped at the timing when the first time t1 has elapsed.

In the recording apparatus 1 of the embodiment, when moving a carriage 10 in a reciprocating operation of the carriage 10 in the direction B corresponds to when ejecting ink from the recording head 9 and corresponds to when stopping the intermittent transport of the recording medium M. Then, a time during transition from moving in one direction to moving in a reverse direction of the carriage 10 in the reciprocating operation of the carriage 10 corresponds to during movement corresponding to a transport length (so-called length of one pass) of a predetermined amount in the intermittent transport of the recording medium M.

Even if the lack of slack of the recording medium M is not eliminated at the timing when the first time t1 has elapsed, the driving of the belt motor 17 is controlled to be stopped after the movement of one pass is completed by the control of the control section 14. That is, the control is performed such that the recording medium M is not stopped at a moving amount of a length less than the length of one pass.

Meanwhile, the delivery motor 16 is turned on if the slack sensor 15 detects the lack of slack of the recording medium M and after the detection, if the elimination of the lack of slack of the recording medium M is detected by the slack sensor 15 before the total time of the first time t1 and the second time t2 has elapsed after the first time t1 has elapsed, the delivery motor 16 is turned off and the speed is gradually decreased and the delivery motor 16 is stopped.

FIG. 5 is a time chart of a case where the slack sensor 15 continuously detects the lack of slack of the recording medium M after the first time t1 has elapsed and further after the second time t2 has elapsed, that is, when the slack sensor 15 does not detect the elimination of the lack of slack of the recording medium M even when the total time of the first time t1 and the second time t2 has elapsed. Next, this state is described.

As described above, if the slack sensor 15 detects the lack of slack of the recording medium M after the first time t1 has elapsed, the driving of the belt motor 17 is stopped.

Then, thereafter, if the slack sensor 15 cannot detect the elimination of the lack of slack of the recording medium M even after the second time t2 has elapsed, in the recording apparatus 1 of the embodiment, the control section 14 determines that an error is generated, stops the driving of the delivery motor 16, the belt motor 17, the carriage 10, and the like, and stops the recording in the recording section 8.

Furthermore, the control section 14 outputs error information to the PC 18 as an output section and also outputs information that the remaining amount of the recording medium M is small to the PC 18.

Moreover, also in this case, the belt motor 17 executes the stop of the driving after the movement corresponding to the transport length of a predetermined amount in the intermittent transport of the recording medium M is completed by the control of the control section 14.

As described above, the recording apparatus 1 of the embodiment includes the delivery section 2 that rotates and delivers the roll-shaped recording medium M, the transport belt 3 that transports the recording medium M delivered from the delivery section 2, and the slack sensor 15 that detects the slackened state in the recording medium M delivered from the delivery section 2 to the transport belt 3. Then, the control section 14 is provided that performs the low speed transport control controlling the transport belt 3 such that the recording medium M is transported by decreasing the transport speed of the recording medium M depending on the transport belt 3 if the slack sensor 15 detects the lack of slack of the recording medium M in the period of the first time t1 or more.

According to such a configuration, the recording medium M is transported while suppressing the lack of the slack of the recording medium M.

Furthermore, as described above, the control section 14 of the embodiment controls the transport belt 3 based on a detection result of the slack sensor 15 in the low speed transport control.

Specifically, in the low speed transport control, the control section 14 resumes the intermittent transport by driving the belt motor 17 by using a signal detecting the elimination of the lack of slack by the slack sensor 15 as a trigger.

According to such a configuration, the recording medium M is transported while suppressing the lack of slack of the recording medium M.

Furthermore, in other words, it can be said that the control section 14 of the embodiment can control the transport belt 3 so as to intermittently move the transport belt 3 and, in the low speed transport control, the control is performed so as to increase the stop time of the transport belt 3 in the intermittent moving of the transport belt 3.

According to such a configuration, the recording medium M is transported while suppressing the lack of slack of the recording medium M.

Furthermore, the control section 14 may be configured to control so as to decrease the moving speed of the transport belt 3 during the moving of the transport belt 3 in the low speed transport control. Here, the moving speed during moving may be controlled such that the maximum speed during moving is decreased or the control for decreasing the average speed during moving may be performed by increasing the time to reach the maximum speed.

According to such a configuration, the recording medium M is transported while suppressing the lack of slack of the recording medium M.

Furthermore, as described above, the control section 14 of the embodiment outputs the information of the remaining amount of the recording medium M if the slack sensor 15 detects the state of the lack of slack of the recording medium M in the period of the first time t1 or more has elapsed.

The roll diameter of the roll-shaped recording medium M is changed between the start of use and the end of use. Thus, even if the slack sensor 15 does not detect the lack of the slack of the recording medium M at the start of the use, the lack of the slack may be detected at the end of the use. Thus, in a case where the slack sensor 15 detects the lack of slack of the recording medium M even after the first time t1 has elapsed, it is possible to determine that the recording medium M is close to the end of the use.

The control section 14 of the embodiment outputs the information of the remaining amount of the recording medium M to the PC 18 if the slack sensor 15 detects the lack of slack of the recording medium M even after the first time t1 has elapsed. Thus, the information of the remaining amount of the recording medium M is notified to the user by outputting the information of the remaining amount of the recording medium M to a monitor of the PC 18 that is an external display device. Thus, the user can determine that the recording medium M is close to end of use.

Furthermore, as described above, the control section 14 of the embodiment controls the delivery section 2 and the transport belt 3 so as to stop the driving of the delivery section 2 and the transport belt 3 if the slack sensor 15 detects the lack of slack of the recording medium M in the period of the total time of the first time t1 and the second time t2 or more.

Thus, for example, if the use of the recording medium M is close to be finished and if the lack of slack of the recording medium M is not eliminated even after the low speed transport is performed in which the transport speed of the recording medium M is decreased during the second time t2, the driving of the delivery section 2 and the transport belt 3 is stopped and further occurrence of defects is suppressed.

Furthermore, as described above, the control section 14 of the embodiment outputs the error information if the slack sensor 15 detects the lack of slack of the recording medium M in the period of the total time of the first time t1 and the second time t2 or more.

Thus, for example, if the use of the recording medium M is close to be finished and the lack of slack of the recording medium M is not eliminated even after the low speed transport is performed in which the transport speed of the recording medium M is decreased during the second time t2, that effect is notified to the user.

Figure 6:
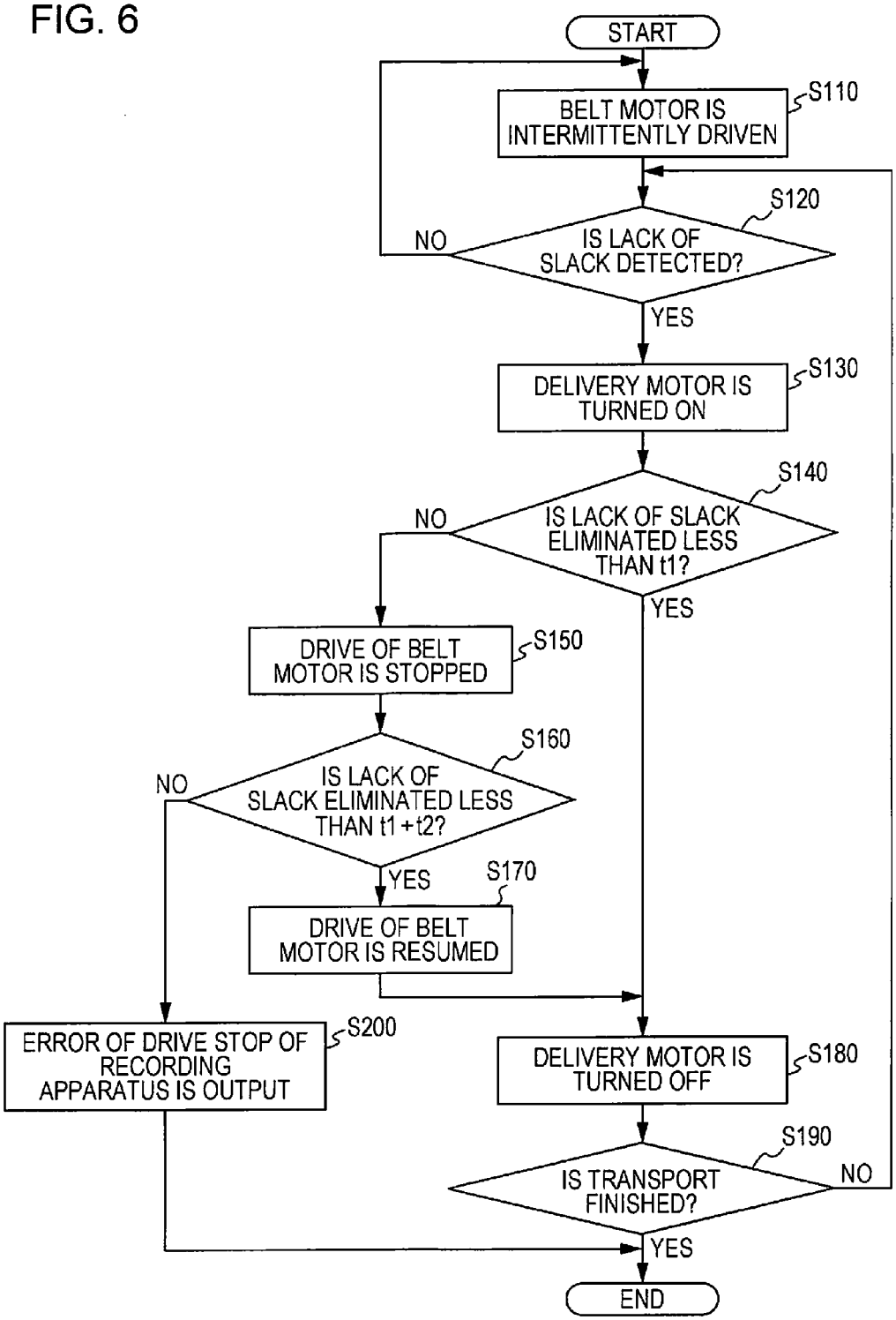
FIG. 6 is a flowchart illustrating a method for transporting the recording medium according to an embodiment of the invention.

Embodiment of Method for Transporting Recording Medium M (FIG. 6)

Next, an embodiment of a method for transporting of the recording medium M using the recording apparatus 1 of the embodiment will be described.

FIG. 6 is a flowchart of the method for transporting of the recording medium M of the embodiment.

If the method for transporting of the recording medium M of the embodiment is started by inputting recording data from the PC 18 by the recording apparatus 1, initially, in step S110, the belt motor 17 is intermittently driven and the transport of the recording medium M is started by the transport belt 3.

Then, in step S120, whether or not the lack of slack is generated is detected by the slack sensor 15.

If the lack of slack is detected in step S120, in step S130, the delivery motor 16 is turned on and the delivery section 2 is driven to rotate.

Then, in step S140, whether or not the lack of slack is eliminated is detected by the slack sensor 15 before the first time t1 has elapsed.

In step S140, if the elimination of the lack of slack is detected, the process proceeds to step S180, the delivery motor 16 is turned off, and the rotational driving of the delivery section 2 is stopped. Then, in step S190, it is determined whether or not the transport of the recording medium M is completed and if it is determined that the transport of the recording medium M is not completed, the process returns to step S120, and if it is determined that the transport of the recording medium M is completed, the method for transporting of the recording medium M of the embodiment is finished.

Furthermore, in step S140, if elimination of the lack of slack is not detected, the process proceeds to step S150.

In step S150, the driving of the belt motor 17 is stopped and new intermittent driving of the transport belt 3 is stopped. In this case, the new intermittent driving being stopped means that start of the intermittent driving of the transport belt 3 is not performed and that the transport belt 3 undergoing movement is not immediately stopped.

Then, in step S160, whether or not the lack of slack is eliminated by the slack sensor 15 before the total time of the first time t1 and the second time t2 has elapsed is detected.

In step S160, if the elimination of the lack of slack is detected, the process proceeds to step S170 and the driving of the belt motor 17 is resumed, and thereby the intermittent driving of the transport belt 3 is resumed. Then, the process proceeds to step S180.

Furthermore, in step S160, if the elimination of the lack of slack is not detected, the process proceeds to step S200 and the driving of each driving section of the recording apparatus 1 such as the delivery motor 16 and the belt motor 17 is stopped and the method for transporting of the recording medium M of the embodiment is completed. Furthermore, in step S200, the error information is output to the PC 18.

As described above, in the method for transporting of the recording medium M of the embodiment, in step S140, if the slack sensor 15 detects the lack of slack of the recording medium M after the first time t1 has elapsed, as illustrated in step S150 to step S170, the recording medium M is transported by decreasing the transport speed of the recording medium M depending on the transport belt 3. Thus, it is possible to transport the recording medium M while suppressing the lack of slack of the recording medium M.

Figure 7:
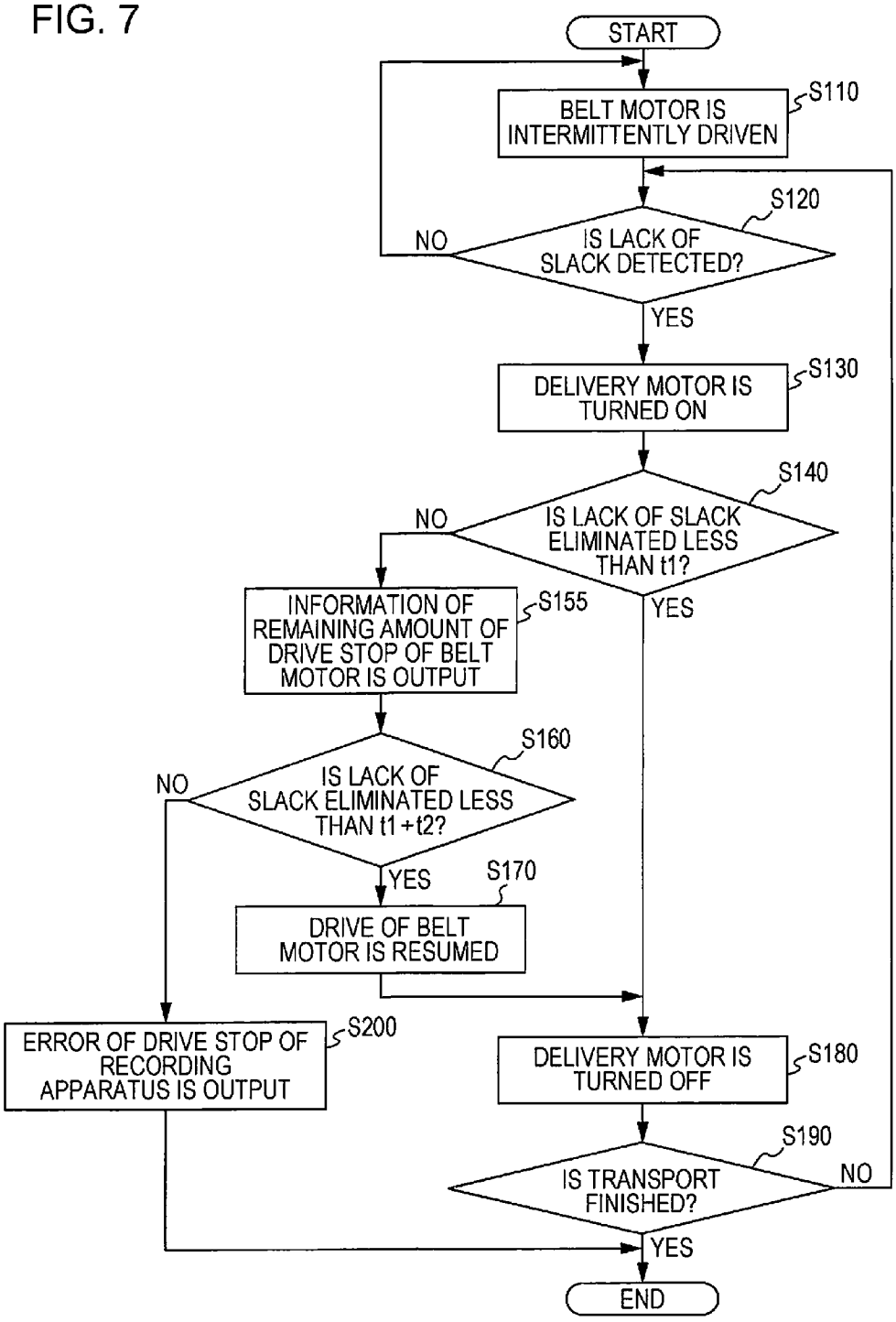
FIG. 7 is a flowchart illustrating a method for notifying information of a remaining amount of the recording medium according to the embodiment of the invention.

Embodiment of Method for Notifying Information of Remaining Amount of Recording Medium M (FIG. 7)

Next, an embodiment of a method for notifying the information of the remaining amount of the recording medium M using the recording apparatus 1 of the embodiment described above will be described.

FIG. 7 is a flowchart of the method for notifying the information of the remaining amount of the recording medium M of the embodiment.

Moreover, steps from step S110 to step S140 and from step S160 to step S200 in the method for notifying the information of the remaining amount of the recording medium M of the embodiment are the same as those steps from step S110 to step S140 and from step S160 to step S200 in the method for transporting of the recording medium M illustrated in FIG. 6. Thus, description of the steps from step S110 to step S140 and from step S160 to step S200 in the method for notifying the information of the remaining amount of the recording medium M of the embodiment will be omitted.

The method for notifying the information of the remaining amount of the recording medium M of the embodiment has step S155 instead of step S150 in the method for transporting of the recording medium M illustrated in FIG. 6.

In step S155, similar to step S150, the driving of the belt motor 17 is stopped and the intermittent driving of the transport belt 3 is stopped, and the information of the remaining amount of the recording medium M is output to the PC 18.

As described above, in the method for notifying of the information of the remaining amount of the recording medium M of the embodiment, the information of the remaining amount of the recording medium M is notified in step S155 if the slack sensor 15 detects the lack of slack of the recording medium M after the first time t1 has elapsed in step S140. Thus, it is possible to notify the information of the remaining amount of the recording medium M to the user and, for example, the user can determine that the use of the recording medium M is close to be finished.

Moreover, the invention is not limited to the above embodiments, various modifications can be made within the scope of the invention described in the claims, and it goes without saying that they are also included within the scope of the invention.

The invention is described in detail above based on specific embodiments. Here, the invention will be described together again.

The recording apparatus 1 of a first aspect of the invention includes the delivery section 2 that rotates and delivers the roll-shaped recording medium M, the transport belt 3 that transports the recording medium M delivered from the delivery section 2, the slack sensor 15 that detects the slackened state in the recording medium M delivered from the delivery section 2 to the transport belt 3, and the control section 14 that performs low speed transport control for controlling the transport belt 3 such that the recording medium M is transported by decreasing the transport speed of the recording medium M depending on the transport belt 3 if the slack sensor 15 detects the lack of slack of the recording medium M in the period of the first time t1 or more.

According to the aspect, the recording medium M is transported by decreasing the transport speed of the recording medium M depending on the transport belt 3 if the slack sensor 15 detects the lack of slack of the recording medium M in the period of the first time t1 or more. Thus, it is possible to suppress a decrease in the transport speed and to transport the recording medium M while suppressing the lack of slack of the recording medium M compared to a configuration in which the transport of the recording medium M is stopped and the error information is notified to the user.

In the recording apparatus 1 of a second aspect of the invention according to the first aspect, the control section 14 controls the transport belt 3 based on the detection result of the slack sensor 15 in the low speed transport control.

According to the aspect, the control section 14 controls the transport belt 3 based on the detection result of the slack sensor 15 in the low speed transport control. According to such a configuration, it is possible to transport the recording medium M while suppressing the lack of slack of the recording medium M.

In the recording apparatus 1 of a third aspect of the invention, according to the first or second aspect, the control section 14 can control the transport belt 3 so as to intermittently move the transport belt 3 and, in the low speed transport control, the control is performed so as to increase the stop time of the transport belt 3 in the intermittent moving.

According to the aspect, the control section 14 can control the transport belt 3 so as to intermittently move the transport belt 3 and in the low speed transport control, the control is performed so as to increase the stop time of the transport belt 3 in the intermittent moving. According to such a configuration, it is possible to transport the recording medium M while suppressing the lack of slack of the recording medium M.

In the recording apparatus 1 of a fourth aspect of the invention, according to any one of the first to third aspects, the control section 14 controls the transport belt 3 so as to decrease the moving speed of the transport belt 3 in the low speed transport control.

According to the aspect, the control section 14 controls the transport belt 3 so as to decrease the moving speed of the transport belt 3 in the low speed transport control. According to such a configuration, it is possible to transport the recording medium M while suppressing the lack of slack of the recording medium M.

The recording apparatus 1 of a fifth aspect of the invention, according to any one of the first to fourth aspects includes the output section that outputs the information of the remaining amount of the recording medium M if the slack sensor 15 detects the lack of slack of the recording medium M in the period of the first time t1 or more.

The roll diameter of the roll-shaped recording medium M is changed between the start of the use and the end of the use. Thus, even if the slack sensor 15 does not detect the lack of slack of the recording medium M at the start of the use, the lack of slack may be detected at the end of the use. Thus, it is possible to determine that the recording medium M is close to the end of use if the slack sensor 15 detects the lack of slack of the recording medium M even after the first time t1 has elapsed.

According to the aspect, the information of the remaining amount of the recording medium M is output if the slack sensor 15 detects the lack of slack of the recording medium M even after the first time t1 has elapsed. Thus, the information of the remaining amount of the recording medium M can be notified to the user by outputting the information of the remaining amount of the recording medium M to an external display device and, for example, the user can determine that the use of the recording medium M is close to be finished.

In the recording apparatus 1 of a sixth aspect of the invention according to any one of the first to fifth aspects, the control section 14 controls the delivery section 2 and the transport belt 3 so as to stop the driving of the delivery section 2 and the transport belt 3 if the slack sensor 15 detects the lack of slack of the recording medium M in the period of the total time of the first time t1 and the second time t2 or more.

According to the aspect, the control section 14 controls the delivery section 2 and the transport belt 3 so as to stop the driving of the delivery section 2 and the transport belt 3 if the slack sensor 15 detects the lack of slack of the recording medium M in the period of the total time of the first time t1 and the second time t2 or more. Thus, for example, if the use of the recording medium M is close to be finished and if the lack of slack of the recording medium M is not eliminated even after the low speed transport is performed in which the transport speed of the recording medium M is decreased during the second time t2, the driving of the delivery section 2 and the transport belt 3 is stopped and further occurrence of defects is suppressed.

The recording apparatus 1 of a seventh aspect of the invention according to the sixth aspect further includes an output section 14 that outputs the error information if the slack sensor 15 detects the lack of slack of the recording medium M in the period of the total time of the first time t1 and the second time t2 or more.

According to the aspect, the output section 14 outputs the error information if the slack sensor 15 detects the lack of slack of the recording medium M in the period of the total time of the first time t1 and the second time t2 or more. Thus, for example, if the use of the recording medium M is close to be finished and the lack of slack of the recording medium M is not eliminated even after the low speed transport is performed in which the transport speed of the recording medium M is decreased during the second time t2, that effect can be notified to the user.

According to an eighth aspect of the invention, there is provided the method for transporting the recording medium M in the recording apparatus 1 including the delivery section 2 that rotates and delivers the roll-shaped recording medium M, the transport belt 3 that transports the recording medium M delivered from the delivery section 2, and the slack sensor 15 that detects the slackened state in the recording medium M delivered from the delivery section 2 to the transport belt 3, the method including performing the low speed transport in which the recording medium M is transported by decreasing the transport speed of the recording medium M depending on the transport belt 3 if the slack sensor 15 detects the lack of slack of the recording medium M in the period of the first time t1 or more.

According to the aspect, the recording medium M is transported by decreasing the transport speed of the recording medium M depending on the transport belt 3 if the slack sensor 15 detects the lack of slack of the recording medium M in the period of the first time t1 or more. Thus, it is possible to transport the recording medium M while suppressing the lack of slack of the recording medium M.

According to a ninth aspect of the invention, there is provided the method for notifying information of the remaining amount of the recording medium M in the recording apparatus 1 including the delivery section 2 that rotates and delivers the roll-shaped recording medium M, the transport belt 3 that transports the recording medium M delivered from the delivery section 2, and the slack sensor 15 that detects the slackened state in the recording medium M delivered from the delivery section 2 to the transport belt 3, the method including notifying the information of the remaining amount of the recording medium M if the slack sensor 15 detects the lack of slack of the recording medium M in the period of the first time t1 or more.

According to the aspect, the information of the remaining amount of the recording medium M is notified if the slack sensor 15 detects the lack of slack of the recording medium M in the period of the first time t1 or more. Thus, the information of the remaining amount of the recording medium M can be notified to the user and, for example, the user can determine that the use of the recording medium M is close to be finished.

According to the illustrated embodiment, there is provided a recording apparatus including: a delivery section that rotates and delivers a roll-shaped recording medium; a transport belt that transports the recording medium delivered from the delivery section; a slack sensor that detects a slackened state in the recording medium delivered from the delivery section to the transport belt; and a control section that performs low speed transport control for controlling the transport belt such that the recording medium is transported by decreasing a transport speed of the recording medium depending on the transport belt if the slack sensor detects a lack of slack of the recording medium in a period of a first time or more.

In the recording apparatus, the control section may control the transport belt based on a detection result of the slack sensor in the low speed transport control.

In the recording apparatus, the control section may be capable of controlling the transport belt so as to intermittently move the transport belt, and may control the transport belt so as to increase a stop time of the transport belt in the intermittent movement in the low speed transport control.

In the recording apparatus, the control section may control the transport belt so as to decrease a moving speed of the transport belt in the low speed transport control.

The recording apparatus may further include an output section that outputs information of a remaining amount of the recording medium if the slack sensor detects the lack of slack of the recording medium in a period of a first time or more.

In the recording apparatus, the control section may control the delivery section and the transport belt so as to stop driving of the delivery section and the transport belt if the slack sensor detects the lack of slack of the recording medium in a total time of the first time and a second time or more.

The recording apparatus may further include an output section that outputs error information if the slack sensor detects the lack of slack of the recording medium in the total time of the first time and the second time or more.

According to the illustrated embodiment, there is provided a method for transporting a recording medium in a recording apparatus including a delivery section that rotates and delivers a roll-shaped recording medium, a transport belt that transports the recording medium delivered from the delivery section, and a slack sensor that detects a slackened state in the recording medium delivered from the delivery section to the transport belt, the method including: performing low speed transport in which the recording medium is transported by decreasing a transport speed of the recording medium depending on the transport belt if the slack sensor detects a lack of slack of the recording medium in a period of a first time or more.

What is claimed is:

1. A method for notifying information of a remaining amount of a recording medium in a recording apparatus including a delivery section that rotates and delivers a roll-shaped recording medium, a transport belt that transports the recording medium delivered from the delivery section, and a slack sensor that detects a slackened state in the recording medium delivered from the delivery section to the transport belt, the method comprising:

determining that a lack of slack of the recording medium is detected in a case where the slack sensor detects the lack of slack in a period of a first time, determining that the remaining amount of the recording medium is close to zero in a case where the slack sensor detects the lack of slack after the first time has elapsed, and notifying the information of the remaining amount of the recording medium if the slack sensor detects the lack of slack of the recording medium after the first time has elapsed, the delivery section being driven to rotate and whether or not the lack of slack is eliminated being detected before the notifying, and the notifying being performed while keeping the delivery section driven to rotate in a case where the lack of slack is not eliminated.

* * * * *